United States Patent [19]

Hamamura et al.

[11] Patent Number: 4,971,838

[45] Date of Patent: Nov. 20, 1990

[54] PRETREATING AGENT FOR METAL SPRAYING AND METHOD FOR FORMING A METAL SPRAY COATING

[75] Inventors: Masuzo Hamamura, Osaka; Kenji Hasui, Ayase; Kazuyoshi Tsuneta, Yokohama; Masanori Nagai, Yokohama, all of Japan

[73] Assignees: Dai Nippon Toryo Company, Ltd., Osaka; Pan Art Craft Co., Ltd., Suita, both of Japan

[21] Appl. No.: 412,623

[22] Filed: Sep. 26, 1989

Related U.S. Application Data

[63] Continuation of Ser. No. 143,716, Jan. 14, 1988, abandoned.

[30] Foreign Application Priority Data

Jan. 16, 1987 [JP] Japan ..... 62-7673

[51] Int. Cl.[5] ..... B05D 1/08; B05D 1/10

[52] U.S. Cl. ..... 427/422; 427/423; 427/404; 427/407.1

[58] Field of Search ..... 427/34, 422, 423, 404, 427/407.1

[56] References Cited

U.S. PATENT DOCUMENTS

| | | | |
|---|---|---|---|
| 3,325,303 | 6/1967 | Lant et al. | 427/423 X |
| 3,932,344 | 1/1976 | O'Day et al. | 260/38 |
| 4,302,483 | 11/1981 | Altorfer | 427/422 |
| 4,518,625 | 5/1985 | Westfall | 427/422 |
| 4,578,310 | 3/1986 | Hatfield | 427/423 X |
| 4,618,504 | 10/1986 | Bosna et al. | 427/423 X |
| 4,714,623 | 12/1987 | Riccio et al. | 427/423 X |

FOREIGN PATENT DOCUMENTS

| | | |
|---|---|---|
| 0178648 | 4/1986 | European Pat. Off. . |
| 1251127 | 9/1967 | Fed. Rep. of Germany . |

OTHER PUBLICATIONS

Patent Abstracts of Japan, unexamined applications, C field, vol. 10, No. 287, Sept. 30, 1986, Kokai No. 61-104060.

Patent Abstracts of Japan, unexamined application, C field vol. 10, No. 287, Sept. 30, 1986, Kokai No. 61-104061.

*Primary Examiner*—Shrive Beck

*Attorney, Agent, or Firm*—Oblon, Spivak, McClelland, Maier & Neustadt

[57] ABSTRACT

A pretreating composition for metal spraying, which comprises a synthetic resin binder and from 25 to 400% by volume, based on the resin binder, of particles having a particle size of from 5 to 200 μm.

4 Claims, 1 Drawing Sheet

PRETREATING AGENT FOR METAL SPRAYING AND METHOD FOR FORMING A METAL SPRAY COATING

This application is a Continuation of application Ser. No. 07/143,716, filed on Jan. 14, 1988, now abandoned.

The present invention relates to a pretreating agent for metal spraying and a method for forming a metal spray coating. More particularly, it relates to a certain specific pretreating agent for metal spraying and a method for forming a metal spray coating on a substrate to be metal-sprayed, which has not been pretreated by physical pretreatment such as blast treatment or chemical pretreatment such as surface treatment.

For example, when steel is the substrate to be coated, it has been common to coat it with a metal less noble than iron, such as zinc or a zinc-aluminum alloy, by electroplating, hot dipping or spraying. By such methods, it is possible to protect iron by virtue of the sacrificial corrosion preventing effect of the coating metal less noble than the iron substrate. Because of this feature, such methods have been used for steel materials for building and construction, thin steel plates for automobiles, various electric casings or various industrial machine materials.

Among the above-mentioned methods, electroplating or hot dipping can not easily be conducted at any other places than the specified plants, because the size of the substrate is limited depending upon the size of the plating bath. Especially in the case of hot dipping, the substrate is dipped in a molten metal at a temperature as high as from 450° to 600° C., whereby a problem of thermal distortion is likely to result, and it is hardly applicable to thin steel plates. Thus, there have been various restrictions.

On the other hand, metal spraying has been used for bridges or steel structures since it has various merits such that no substantial dimensional distortion takes place since the substrate is not substantially heated, that the spray coating can be obtained in any desired thickness, that even a large substrate can be treated at the site, and that an organic coating material can readily adhere to the spray coating. It is expected that its application will still be expanded in the future.

However, when a metal is coated directly on a smooth surface of e.g. steel or plastic material by metal spraying, the adhesion of the metal spray coating to the substrate is extremely poor because no affinity or chemical bond is obtained as between the substrate and the metal spray coating.

To overcome such a drawback, it has been common to subject the smooth surfaced substrate to blast treatment such as sand blasting or grit blasting to provide an anchoring effect between the substrate and the metal spray coating (e.g. Japanese Unexamined Patent Publication No. 65335/1975).

However, a high level of skill is required for the operation of such a blast treatment as the pretreatment, and it takes a long period of time for the operation. Further, a substantial amount of dust produced by the blasting creates not only problems from the safety and hygiene aspects of the operation but also an environmental pollution problem. Therefore, a certain preventive treatment had to be taken, and thus such a process has been disadvantageous also from the aspect of the processing costs.

When a thin steel plate or plastic having a thickness of not more than about 1 mm is subjected to blast treatment, it frequently happens that a substantial distortion is created by the impact force of the blasting material, or in an extreme case, the substrate breaks. Therefore, when blast treatment was applied to e.g. a thin plate for an automobile body having a thickness of from 0.5 to 0.8 mm, it used to be required to employ a treating method wherein the impact force is particularly weakened, and therefore the decrease in the operation efficiency due to the deterioration in the blasting force used to be a problem.

Further, various undesirable problems used to be brought about by the blasting material which scatters or bounces in a disorderly fashion or by the dust scattered by the treatment as the blasting material or the dust enters into various mechanical parts.

Further, when metal spraying is applied to a welded portion of steel for preventing corrosion, blast treatment is preliminarily required. However, such treatment was practically very difficult because of the hardness of the welded portion.

Under the circumstances, it has been proposed to conduct metal spraying without applying such blast treatment.

For example, there have been known a method wherein metal spraying is applied to a thin steel plate plated with a certain specific metal (Japanese Unexamined Patent Publication No. 50156/1985), a method wherein a metal surface is roughened by an etching solution (Japanese Unexamined Patent Publication No. 50157/1985), and a method wherein a steel plate is heated to form an oxidized coating layer having a certain specific thickness (Japanese Unexamined Patent Publication No. 26763/1986). However, in each of these methods, the substrate is required to be treated under a special environment, whereby the type of the substrate which can be treated is very limited. Thus, these methods are not practical.

Further, in a very special field, a method for providing a special anchoring effect has been proposed. For example, in the spraying of ceramics required to be melted at a very high temperature, it has been proposed to apply an undercoating containing an inorganic filler to the substrate pretreated by zinc phosphate treatment or by sand blast treatment (e.g. Japanese Unexamined Patent Publications No. 104060/1986 and No. 104061/1986). Although this method may provide an adequate anchoring effect, it does not solve the above-mentioned problems involved in the blast treatment.

As described in the foregoing, in the conventional metal spraying methods, the necessity of preliminarily applying blast treatment to the substrate has substantially restricted the scope of the application of such metal spraying. Under the circumstances, in this field, it has been strongly desired to develop or establish a method for metal spraying which does not require application of blast treatment.

It is an object of the present invention to solve the above-mentioned various problems inherent to the conventional metal spraying methods and to provide a special pretreating agent for metal spraying and a method for forming a metal spray coating by means of such a pretreating agent without requiring a conventional pretreatment such as blast treatment.

More specifically, it is an object of the present invention to obtain a corrosion resistant coating, an electrically conductive coating, an electromagnetic wave shielding layer, a durable coating or a coating having a metallic appearance by applying metal spraying without pretreatment to the surface of various substrates such as metal, plastic or inorganic substrates.

The present invention provides a pretreating composition for metal spraying, which comprises a synthetic resin binder and from 25 to 400% by volume, based on the resin binder, of particles having a particle size of from 5 to 200 μm.

The present invention also provides a method for forming a metal spray coating, which comprises coating on a non-pretreated substrate to be metal-sprayed, a composition comprising a synthetic resin and from 25 to 400% by volume, based on the resin, of particles having a particle size of from 5 to 200 μm, in an amount of from 10 to 300 g/m$^2$ to form a coating having a surface roughness (Rz) of from 30 to 250 μm and then spraying a metal on the coating.

Now, the present invention will be described in detail with reference to the preferred embodiments.

Figure 1:
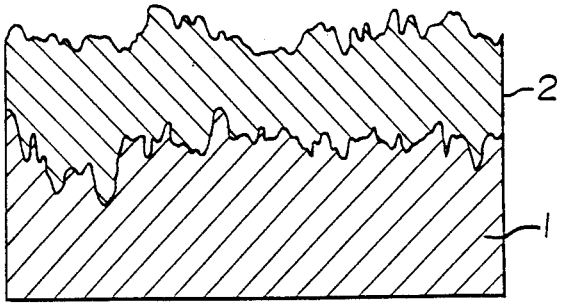
FIG. 1 is a cross-sectional view of a spray coating according to a conventional method.

The substrate to be used in the method of the present invention includes iron materials such as tin plates, dull finish steel plates, cold rolled steel plates, black skin steel plates, surface-treated rusted steel plates and welded steel plates; non-ferrous metals such as aluminum and zinc; plastics such as ABS, PPO and polyvinyl chloride; inorganic materials such as slates, calcium silicate plates and cement structures; and various other substrates such as glass, wood, laminated plates and organic resin films (coating films).

The composition to be applied prior to the metal spraying in the method of the present invention contains particles having an average particle size of from 5 to 200 μm. Such particles may be made of, for example, a metal such as copper, nickel, aluminum, zinc, iron or silicon, or its alloy or its oxide, nitride or carbide. Specifically, the particles may be made of, for example, aluminum oxide, silicon oxide, iron oxide, silicon carbide or boron nitride.

Depending upon the type of the solvent of the composition, there may be employed a powder of an acrylic resin, a styrene resin, an epoxy resin or a polyethylene.

These particles may be composed of one type or a mixture of two or more different types.

Silica, alumina and silicon carbide are particularly preferred in that they are chemically stable against the resin to be used, they do not form a corrosion cell together with the spray material, and they are hard and scarcely undergo sedimentation in the composition.

In the present invention, said particles have a particle size of from 5 to 200 μm, preferably to 100 μm. If the particle size exceeds 200 μm, the particles tend to undergo sedimentation in the resin composition, and they tend to lead to clogging of the nozzles during the spray coating. Even if the composition can be coated, the surface roughness tends to be too coarse, and the surface of the metal spray coating will be coarse, thus leading to a poor outer appearance. On the other hand, if the particle size is less than 5 μm, no adequate surface roughness will be obtained even when the resin composition is coated on the surface of the substrate, and it will be difficult to obtain a metal spray coating having excellent adhesion.

In the present invention, the particles are used in an amount within a range of from 25 to 400% by volume, (pigment volume concentration (PVC): 20–80%), preferably from 65 to 150% by volume (pigment volume concentration (PVC): 40–60%) relative to the resin. If the amount of the particles relative to the resin is less than 25% by volume, the resin content tends to be excessive, whereby the surface roughness tends to be small, and the adhesion of the metal spray coating tends to be poor. Further, the amount of the resin coated on the substrate tends to be substantial, and an insulating layer will be formed, such being undesirable especially when the spray coating is to be employed for sacrificial corrosion prevention.

On the other hand, if the amount of the particles relative to the resin exceeds 400% by volume, the resin content tends to be too small, and the bonding strength between the particles tends to be weak, whereby the adhesion of the metal spray coating will be low, such being undesirable.

There is no particular restriction as to the resin to be used in the present invention so long as it has proper dryable properties, hardness, adhesiveness, water resistance and durability.

Specific examples include one part room temperature drying type resins such as a thermoplastic acrylic resin, a vinyl resin, a chlorinated rubber and an alkyd resin, two-pack type resins such as an unsaturated polyester resin, an acrylic-urethane resin, a polyester-urethane resin and an epoxy resin, thermosetting resins such as a melamine-alkyd resin, a melamine-acrylic resin, a melamine-polyester resin, an acrylic resin, an acrylic-urethane resin.

These resins may be used alone or in combination as a mixture of two or more different types.

Particularly preferred are an epoxy resin (in combination with a curing agent such as a polyamide resin or an amine adduct), an acrylic-urethane resin and an acrylic resin, which are thermoplastic during metal spraying so that sprayed metal particles penetrate into the coating layer which hardens after the spraying.

The composition of the present invention may contain, in addition to the above resin component, an organic solvent or water for dissolving or dispersing the resin, as the case requires.

Further, additives such as a dyestuff, a pigment, a dispersing agent, a defoaming agent and a thixotropic agent, may also be incorporated.

The above composition may take any form such as a solvent form, an aqueous solution form, an aqueous dispersion form or a solvent dispersion form. However, in a case where it is applied to a plastic having poor solvent resistance, it is preferred to employ a composition of aqueous type. When an aqueous type resin composition is used for iron materials, it is necessary to take a measure to prevent the formation of rust.

In the present invention, the composition can be prepared by mixing the resin and the particles, if necessary, together with a solvent or a dispersing medium or various additives, by a usual dispersing and mixing method.

The resin composition thus obtained may be applied to the substrate by a method commonly used for a usual coating composition. It is particularly preferred to employ an air spray method since the coating amount can thereby be readily controlled. However, like in the case of a usual coating material, it is of course possible to employ brush coating or roll coating by properly adjusting the compositon or the viscosity.

In the present invention, the composition is coated in an amount of from 10 to 300 g/m$^2$ particularly preferred is an amount within a range of from about 20 to about 150 g/m$^2$. If the amount is less than 10 g/m$^2$, the surface roughness tends to be small, and the efficiency of metal spraying tends to be poor, and the adhesion of the spray coating tends to be low, such being undesirable. On the other hand, if the coating amount exceeds 300 g/m$^2$, the surface roughness tends to be coarse, or depending upon the composition or the nature of the pretreating composition, the coating layer tends to be too smooth that the adhesion of the metal spray coating tends to be poor, such being undesirable. Especially when a sacrificial corrosion preventing effect of the metal spray coating is desired for the prevention of corrosion of the substrate, if the coating amount exceeds about 300 g/m$^2$, an insulating layer is likely to be formed between the substrate and the metal spray coating, whereby it is hardly possible to obtain the sacrificial corrosion preventing effect.

In the present invention, the surface roughness (Rz) of the coating after the application of the composition is required to be within a range of from 30 to 250 μm, preferably from 60 to 120 μm. For the purpose of the present invention, the surface roughness (Rz) means a ten specimen average roughness according to JIS B-0601 (1982) "the definition and the representation of surface roughness", and the surface roughness (Rz) was measured by a surface roughness shape measuring apparatus Surfcom 554A, manufactured by Tokyo Seimitsu K.K.

If the surface roughness is less than 30 μm, the efficiency of the spraying tends to be low, and the adhesion of the metal spray coating tends to be substantially low. On the other hand, if the surface roughness exceeds 250 μm, the spray coating surface tends to be coarse, whereby the outer appearance will be inferior, and it may happen that when the spray coating layer is rubbed, the undercoating resin layer will be exposed, such being undesirable.

In the method of the present invention, the surface roughness of the coating obtained by the composition is very important. This surface roughness is determined by the particle size and the content of the particles contained in the composition and the coating amount of the composition to the substrate.

For example, it is possible to obtain the desired surface roughness by applying the above-mentioned composition by an air spray method within the above-mentioned range of the coating amount in a more or less dry spray fashion. Otherwise, it is also possible to obtain the desired surface roughness by imparting a thixotropic nature to the above specified composition as the case requires and then coating the composition by means of e.g. a brush.

In the present invention, a metal is sprayed onto the coating thus obtained which has the specific surface roughness.

The coating prior to the metal spraying may not necessarily be completely dried (or cured). Namely, the coating may be in a half-dried (or half-cured) state. Most preferably, the coating is dried and then a metal is sprayed thereon, followed by complete curing.

In the present invention, the metal spraying may be conducted by any spraying method such as a gas flame spraying method, an electric arc spraying method or a low temperature spraying method by means of a depressurized arc spraying machine.

As the metal useful for such spraying methods, it is possible to employ any commonly employed metal such as zinc, a zinc-aluminum alloy, aluminum, red brass, brass or cupro-nickel.

According to the method of the present invention, the metal spray coating has a strong adhesion by virtue of the surface roughness of the coating obtained by the resin composition, and yet the particles in the coating obtained by the resin composition are firmly bonded to the substrate by the bonding force of the resin (organic substance). Accordingly, it is necessary to avoid such a condition that during the operation of the method of the present invention, the resin component in the coating obtained from the resin composition is completely burned out by the heat of the sprayed metal particles.

Namely, in the present invention, the metal spraying is preferably conducted at a relatively low temperature so that the resin composition in the coating obtained by the resin composition will not be completely burned out. For example, it is preferred to employ a low temperature spraying method by means of a vacuum arc spraying machine.

The low temperature spraying method comprises continuously melting a metal wire by electrical arc under an environment where by means of a low temperature air stream jetted in a cylindrical form, the pressure at the central portion is reduced to a level of not higher than 0.5 kg/cm$^2$, and at the same time, the melted metal is aspirated to the front jet stream for pulverization and rapid cooling to a temperature around room temperature, whereby melted metal particles will be deposited in a super-cooled liquid state on the substrate. Accordingly, by this method, the spraying amount per unit hour can be relatively increased, and it is possible to obtain a relatively thick spray coating. On the other hand, the gas flame spraying method or the electric arc spraying method may be used for the method of the present invention by reducing the diameter of the wire of the metal for spraying, or by slowing down the feeding speed of the metal wire, or by reducing the amount of the spraying, or by reducing the thickness of the spray coating.

Now, the surface states obtained by the method of the present invention and by the conventional method will be briefly explained with reference to the drawings (cross-sectional views).

Firstly, FIG. 1 is a cross-sectional view of the surface state obtained by the conventional method. Namely, it shows a case where a substrate 1 was subjected to blast treatment, followed by metal spraying to form a metal spray coating 2.

Figure 2:
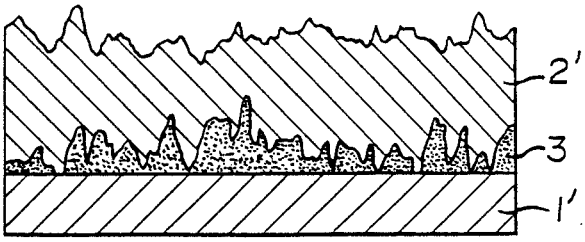
FIG. 2 is a cross-sectional view of a spray coating according to the method of the present invention.

FIG. 2 is a cross-sectional view of the surface state obtained by the method of the present invention, which comprises a smooth surfaced substrate 1', a coating 3 obtained by the resin composition and a metal spray coating 2'.

Figure 3:
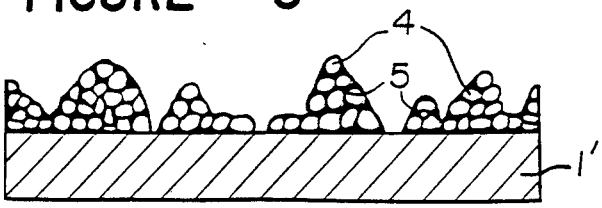
FIG. 3 is a diagramatically enlarged cross-sectional illustration of a resin coating according to the present invention.

Further, FIG. 3 diagramatically illustrates one embodiment of the coating obtained by the composition of the present invention in an enlarged scale.

In the present invention, firstly, the resin composition is applied to the substrate 1' in an amount of from 10 to 300 g/m$^2$ in a dry spray fashion, whereby many particles 4 in the composition will be in a piled state of a pyramid shape (see FIG. 3). On the surface of the coated individual particles, a resin layer 5 having a thickness of from a few μm to a few tens μm is present, and when the resin is dried, the particles are thereby firmly bonded to present the desired surface roughness.

Now, the present invention will be described in further detail with reference to Examples. However, it should be understood that the present invention is by no means restricted by these specific Examples.

EXAMPLE 1

A monomer composition comprising 400 g of methyl methacrylate, 500 g of butyl acrylate, 80 g of 2-hydroxyethyl methacrylate and 20 g of methacrylic acid was subjected to emulsion polymerization by using 10 g of sodium dodecylbenzenesulfonate as an emulsifier and 3 g of ammonium persulfate as an initiator, to obtain an emulsion having 40% by weight of the residue upon heating. To this emulsion, a neutralizing amine, a film-forming assistant, a defoaming agent and a thickener were added to obtain an acrylic emulsion resin A having 36% by weight of the residue upon heating. Then, 306 g (resin solid content volume: 100 $cm^3$) of the resin A and 240 g (volume of particles: 100 $cm^3$, PVC: 50%) of silica sand having an average particle size of 100 μm (silica sand OS8, manufactured by Okumura Yogyo Genryo, specific gravity: 2.4) were mixed and thoroughly stirred to obtain a resin composition A. This resin composition A was applied by an air spray in an amount of 60 $g/m^2$ to a dull finish steel plate of 0.8×100×200 mm to obtain a coating having a surface roughness (Rz) of 110 μm, followed by drying for 1 hour. Then, zinc was sprayed by low temperature spraying to obtain a spray coating having a thickness of 200 μm. The low temperature spraying was conducted under such conditions that a zinc wire having a wire diameter of 1.1 mm was fed at a speed of 12 m/min. (spraying amount: 9.8 kg/hr.) by a low temperature spraying machine PA600 at a voltage of 15 V, at a current of 300 A by using a shaving air under an air pressure of 6 $kg/cm^2$ with an air amount of 1.6 $m^3$/min and with a spraying distance of 20 cm.

The vertical tensile strength of the zinc spray coating thus obtained was 80 $kg/cm^2$, thus indicating excellent adhesion. Further, the spray coating was peeled to expose the base with a width of 10 mm, and a salt spray test was conducted for 1,000 hours. By virtue of the sacrificial corrosion preventing effect of zinc, no formation of red rust was observed from the peeled portion, and the entire surface was covered with a white rust of zinc, thus showing excellent corrosion resistance.

EXAMPLE 2

80 g of xylene, 60 g of methyl ethyl ketone and 25 g of butanol were added to 100 g of an epoxy resin (Epiclon 4051, manufactured by Dai Nippon Ink Chemical Industries, epoxy equivalent: 950), and the resin was dissolved. Then, 10 g of a polyamide resin (Epicure 892, manufactured by Celanese, active hydrogen equivalent: 133) was added thereto to obtain an epoxy-polyamide resin B having 40% by weight of the residue upon heating. 275 g (resin solid content volume: 100 $cm^3$) of the epoxy-polyamide resin B and 221 g (volume of particles: 70 $cm^3$, PVC: 41%) of silicon carbide having an average particle size of 48 μm (green silicon carbide CG320, manufactured by Nagoya Kenma Kizai Kogyo, specific gravity: 3.16) were thoroughly stirred to obtain a resin composition B. The resin composition B was applied by an air spray in an amount of 30 $g/m^2$ to a cold rolled steel sheet of 0.8×100×200 mm to obtain a coating having a surface roughness (Rz) of 60 μm, followed by drying for 2 hours. Then, zinc was sprayed in the same manner as in Example 1 to obtain a spray coating having a thickness of 100 μm.

The vertical tensile strength of the zinc spray coating thus obtained was 90 $kg/cm^2$, thus indicating excellent adhesion. Further, the spray coating was peeled to expose the base with a width of 10 mm, and a salt spray test was conducted for 1,000 hours. By virtue of the sacrificial corrosion preventing effect of the zinc, no formation of red rust was observed at the peeled portion, and the entire surface was covered with a white rust of zinc, thus indicating excellent corrosion resistance.

EXAMPLE 3

33 g of an isocyanate resin (Sumidule N75, manufactured by Sumitomo Bayer Urethane, residue upon heating: 75% by weight) was added to 170 g of an acryl polyol resin (hydroxyl value: 100, residue upon heating: 50%) to obtain a solvent type urethane-acrylic resin having 54% by weight of the residue upon heating. 203 g (resin solid content volume: 100 $cm^3$) of this solvent type urethane-acrylic resin and 119 g (volume of particles: 30 $cm^3$, PVC 23%) of aluminum oxide having an average particle size of 20 μm (white molten alumina WA800, manufactured by Nagoya Kenma Kizai Kogyo, specific gravity: 3.96) were thoroughly stirred to obtain a resin composition C.

This resin composition C was diluted with a thinner and applied by an air spray in an amount of 15 $g/m^2$ to a tin plate of 0.3×100×200 mm to obtain a coating having a surface roughness (Rz) of 40 μm, followed by drying for 2 hours. Then, zinc was sprayed by low temperature spraying in the same manner as in Example 1 to obtain a spray coating having a thickness of 100 μm.

The vertical tensile strength of the zinc spray coating thus obtained was 60 $kg/cm^2$, thus indicating excellent adhesion. Further, the spray coating was peeled to expose the base with a width of 10 mm, and a salt spray test was conducted for 1,000 hours. By virtue of the sacrificial corrosion preventing effect of zinc, no formation of red rust was observed at the peeled portion, and the entire surface was covered with a white rust of zinc, thus indicating excellent corrosion resistance.

EXAMPLE 4

12.5 g of a water-soluble melamine resin having 80% by weight of the residue upon heating (Sumimal M 30W, manufactured by Sumitomo Chemical Industries) was added to 278 g of the acryl emulsion resin A having 36% by weight of the residue upon heating as prepared in Example 1, to obtain a thermosetting aqueous dispersion type melamine-acrylic resin D. 291 g (resin solid content volume: 100 $cm^3$) of this melamine-acrylic resin D and 720 g (volume of particles: 300 $cm^3$) of silica sand having an average particle size of 70 μm (Silica Powder Special Grade, manufactured by Okumura Yogyo Genryo, specific gravity: 2.4) were thoroughly stirred to obtain a resin composition D.

This resin composition D was applied by brush coating in an amount of 100 $g/m^2$ to a glass plate of 2×100×200 mm to obtain a coating having a surface roughness (Rz) of 40 μm, followed by drying for 2 hours. Then, a zinc-aluminum pseudo-alloy was sprayed by low temperature spraying to form a spray coating having a thickness of 100 μm, and thereafter heat curing was conducted at 130° C. for 20 minutes.

The low temperature spraying was conducted under such conditions that a zinc wire and an aluminum wire both having a diameter of 1.1 mm were fed at a speed of 12 m/min. (spraying amount: 6.4 kg/hr.) by a low temperature spraying machine PA600, at a voltage of 17 V at a current of 350 A by using a shaving air under an air pressure of 6 kg/cm$^2$ in an air amount of 1.6 m$^3$/min. and with a spraying distance of 20 cm.

The vertical tensile strength of the zinc spray coating thus obtained was 50 kg/cm$^2$, thus showing excellent adhesion.

EXAMPLE 5

A rusted steel plate of SS41 of 3.6×100×200 mm was surface-treated by an electric wire brush to a level of DSt3 by SIS.05 5900-1967. Then, the resin composition B as prepared in Example 2 was applied by an air spray in an amount of 80 g/m$^2$ to obtain a coating having a surface roughness (Rz) of 80 μm, followed by drying for 2 hours. Then, zinc was sprayed by low temperature spraying in the same manner as in Example 1 to obtain a spray coating having a thickness of 150 μm.

The vertical tensile strength of the zinc spray coating thus obtained was 60 kg/cm$^2$, thus indicating excellent adhesion. Further, the spray coating was peeled to expose the base with a width of 10 mm, and a salt spray test was conducted for 1,000 hours. By virtue of the sacrificial corrosion preventing effect of zinc, no formation of red rust was observed at the peeled portion, and the entire surface was covered with a white rust of zinc, thus indicating excellent corrosion resistance.

EXAMPLE 6

The resin composition A as prepared in Example 1 was applied by an air spray in an amount of 40 g/m$^2$ to a PPO (modified polyphenylene oxide) plate to obtain a coating having a surface roughness (Rz) of 90 μm, followed by drying for 1 hour. Then, zinc was sprayed by low temperature spraying in the same manner as in Example 1 to form a spray coating having a thickness of 50 μm.

The vertical tensile strength of the zinc spray coating thus obtained was 70 kg/cm$^2$, thus indicating excellent adhesion. The electromagnetic wave shielding properties were measured, whereby excellent electromagnetic wave shielding properties were obtained at a level of 65 dB at 500 Hz. Further, a humidity test was conducted for 1,000 hours, whereby no peeling or blistering was observed although a white rust of zinc was slightly observed over the entire surface, and the cross cut test for the secondary adhesion also gave good results.

EXAMPLE 7

The resin composition C as prepared in Example 3 was applied by an air spray in an amount of 80 g/m$^2$ to a black skin steel plate of SS41 of 3.6×100×200 mm to obtain a coating having a surface roughness (Rz) of 80 μm, followed by drying for 12 hours. Then, zinc spraying was conducted by a gas flame spraying machine to obtain a spray coating having a thickness of 75 μm.

The gas flame spraying was conducted under such conditions that a zinc wire having a wire diameter of 3.2 mm was fed at a rate of 1 m/min. (spraying amount: 3.8 kg/hr.) by using a wire melting type flame spraying machine type 11E model gun, manufactured by METECO CO., with a spraying distance of 30 cm.

The vertical tensile strength of the zinc spray coating thus obtained was 55 kg/cm$^2$, thus indicating excellent adhesion. Further, the spray coating was peeled to expose the base with a width of 10 mm, and a salt spray test was conducted for 1,000 hours. By virtue of the sacrificial corrosion preventing effect of zinc, no formation of red rust was observed at the peeled portion, and the entire surface was covered with a white rust of zinc, thus indicating excellent corrosion resistance.

COMPARATIVE EXAMPLE 1

A thin dull finish steel plate of 0.8×100×200 mm was subjected to grit blasting to obtain a surface roughness (Rz) of 100 μm, whereby the steel plate was so much curved that it was impossible to use it for metal spraying test.

A SS41 steel plate of 3.6×100×200 mm was subjected to grit blasting to obtain a surface roughness (Rz) of 100 μm. The grit blasting treatment required a treating time of at least 10 times as compared with the resin composition coating step of the present invention.

Then, zinc was sprayed by low temperature spraying in the same manner as in Example 1 to this blast treated steel plate in a thickness of 200 μm. The vertical tensile strength of the zinc spray coating thus obtained was 70 kg/cm$^2$, thus indicating excellent adhesion. Further, the spray coating was peeled to expose the base with a width of 10 mm, and a salt spray test was conducted for 1,000 hours. By virtue of the sacrificial corrosion preventing effect of zinc, no formation of red rust was observed at the peeled portion, and the entire surface was covered with a white rust of zinc, thus indicating excellent corrosion resistance as in Example 1.

COMPARATIVE EXAMPLE 2

A dull finish steel plate of 0.8×100×200 mm was subjected to sand blasting to obtain a surface roughness (Rz) of 40 μm. The steel plate was curved to some extent, but was useful for a spraying test.

However, the blast treatment required a treating time of at least 20 times as compared with the coating step of the resin composition of the present invention.

Then, zinc was sprayed by low temperature spraying in the same manner as in Example 1 to this blast treated steel plate to obtain a spray coating having a thickness of 200 μm. The vertical tensile strength of the zinc spray coating thus obtained was relatively low at a level of 45 kg/cm$^2$. The spray coating was peeled to expose the base with a width of 10 mm, and a salt spray test was conducted for 1,000 hours. By virtue of the sacrificial corrosion preventing effect of zinc, no formation of red rust was observed from the peeled portion, and the entire surface was covered with a white rust of zinc, thus indicating excellent corrosion resistance as in Example 1.

COMPARATIVE EXAMPLE 3

306 g (resin solid content volume: 100 cm$^3$) of the acrylic emulsion resin A as used in Example 1 and 240 g (volume of particles: 100 cm$^3$, PVC: 50%) of silica sand having an average particle size of 230 μm (Silica Sand OS6, manufactured by Okumura Yogyo Genryo, specific gravity: 2.4) were thoroughly stirred to obtain a resin composition a. This resin composition a tended to undergo sedimentation of particles when left to stand for a few hours, and it became hardly redispersible in a few days.

Immediately after the preparation, the resin composition a was applied by an air spray in an amount of 35 g/m$^2$ to a dull finish steel plate of 0.8×100×200 mm to obtain a surface roughness (Rz) of 300 μm, followed by drying for 1 hours. Then, zinc was sprayed by low temperature spraying in the same manner as in Example 1 to form a spray coating having a thickness of 100 μm. The spray coating was very coarse, and the outer appearance was inferior.

The vertical tensile strength of the zinc spray coating thus obtained was as low as 25 kg/cm$^2$, thus indicating poor adhesion. Further, the spray coating was peeled to expose the base with a width of 10 mm, and a salt spray test was conducted for 200 hours, whereby no sacrificial corrosion preventing effect was observed, and substantial formation of red rust was observed at the peeled portion.

COMPARATIVE EXAMPLE 4

275 g (resin solid content volume: 100 cm$^3$) of the epoxy-polyamide resin B as used in Example 2 and 63 g (volume of particles: 20 cm$^3$, PVC: 17%) of silicon carbide having an average particle size of 48 μm (green silicon carbide CG320, manufactured by Nagoya Kenma Kizai Kogyo, specific gravity: 3.16) were thoroughly stirred to obtain a resin composition b. This resin composition b was applied by an air spray to a cold rolled steel sheet of 0.8×100×200 mm in an amount of 9 g/m$^2$ to obtain a surface roughness (Rz) of 25 μm. After drying 2 hours, zinc was sprayed in the same manner as in Example 1 to obtain a spray coating having a thickness of 100 μm. However, the spraying efficiency was poor, and it took a spraying time of at least 3 times as compared with Example 2.

The vertical tensile strength of the zinc spray coating thus obtained was as low as 20 kg/cm$^2$, thus indicating poor adhesion. Further, the spray coating was peeled to expose the base with a width of 10 mm, and a salt spray test was conducted, whereby the spray coating was blistered in about 300 hours.

COMPARATIVE EXAMPLE 5

275 g (resin solid content volume: 100 cm$^3$) of the epoxy-polyamide resin B as used in Example 2 and 383 g (volume of particles: 70 cm$^3$, PVC: 30%) of a nickel powder having an average particle size of 30 μm (specific gravity: 8.9) were thoroughly stirred to obtain a resin composition c.

This resin composition c was applied by an air spray to a dull finish steel of 0.8×100×200 mm in an amount of 340 g/m$^2$ (thickness: 100 μm) to obtain a surface roughness (Rz) of 20 μm. After drying 12 hours, zinc was sprayed in the same manner as in Example 1 to obtain a spray coating having a thickness of 100 μm. However, the spraying efficiency was poor, and it took a spraying time of at least 3 times as compared with Example 2.

Further, the vertical tensile strength of this zinc spray coating was as low as 15 kg/cm$^2$, thus indicating very poor adhesion.

Further, the spray coating was peeled to expose the base with a width of 10 mm, and a salt spray test was conducted, whereby red rust formed at the peeled portion in about 100 hours, thus indicating poor corrosion resistance.

According to the present invention, it is possible to provide a proper surface roughness to a smooth surfaced substrate without applying blast treatment as required in the conventional methods, whereby it is possible to apply metal spraying to a substrate which has a small thickness or a complicated shape and thus can not be subjected to blast treatment. Further, the method can be applied to a material to which metal spraying used to be hardly applicable. Yet, the adhesion of the spray coating thereby obtained is excellent.

According to the method of the present invention, a high adhesive force can be obtained by the anchoring effect which is obtainable by filling the sprayed metal particles among the particles in the coating obtained by the resin composition by utilizing the plasticity of the sprayed molten metal particles.

For example, the vertical tensile strength of the metal spray coating on the conventional blast treated surface is about 60 kg/cm$^2$. Whereas, the vertical tensile strength of the metal spray coating obtained by the method of the present invention is at a level of from 50 to 80 kg/cm$^2$, thus being comparable or superior to the conventional products in the adhesion.

Further, it is possible to protect the substrate (steel material) by the sacrificial corrosion preventing effect of the metal spray coating. This is the effect created by the contact of the metal spray coating and the substrate (steel material). However, even if the substrate surface is covered with a thin coating of a resin, cohesive failure of the coating is caused by e.g. collision by sprayed metal particles, whereby the sprayed particles reach the surface of the substrate and the sacrificial corrosion preventing effect can adequately be obtained.

According to the method of the present invention, the treating time can be reduced to from 1/10 to 1/20 of the time required for the conventional blast treatment, whereby a substantial reduction of the processing cost can be made.

Further, various problems relating to the dust generated by the blast treatment, i.e. so called pollution problems, can also be solved by the method of the present invention.

Thus, the present invention contributes significantly to the utilization of the metal spraying technique in the future, and the practical industrial value is therefore substantial.

We claim:

1. A method for forming a metal spray coating, which consists essentially of coating on a non-pretreated substrate to be metal-sprayed, a composition comprising a synthetic resin and from 25 to 400% by volume, based on the resin, of particles having a particle size of from 5 to 200 μm, in an amount of from 10 to 300 g/m$^2$ to form a coating having a surface roughness (Rz) of from 30 to 250 μm and then spraying a metal on the coating.

2. The method according to claim 1, wherein the substrate to be metal-sprayed is made of steel, and the metal to be sprayed is a metal less noble than steel.

3. The method according to claim 1, wherein the particles are made of at least one member selected from the group consisting of silicon oxide, alumina and silicon carbide.

4. The method according to claim 1, wherein the metal spraying is conducted by low temperature spraying by means of a depressurized arc spraying machine.

* * * * *